United States Patent [19]

Knop

[11] Patent Number: 4,911,375

[45] Date of Patent: Mar. 27, 1990

[54] DEVICE FOR ADJUSTING A CHUCK TO AXIALLY TENSION CORE TUBES

[75] Inventor: Reinhard Knop, Bochum, Fed. Rep. of Germany

[73] Assignee: Jagenberg AG, Dusseldorf, Fed. Rep. of Germany

[21] Appl. No.: 260,805

[22] Filed: Oct. 21, 1988

[30] Foreign Application Priority Data

Oct. 21, 1987 [DE] Fed. Rep. of Germany ..... 3735557

[51] Int. Cl.[4] ..... B65H 18/02

[52] U.S. Cl. ..... 242/68.4; 279/1 DC

[58] Field of Search ..... 242/68.1, 68.3, 68.4; 279/1 DC, 1 E, 1 L

[56] References Cited

U.S. PATENT DOCUMENTS 4,483,493 11/1984 Schonmeier ..... 242/68.4 X 4,697,756 10/1987 Kofler ..... 242/68.4 X

FOREIGN PATENT DOCUMENTS 2628788 3/1978 Fed. Rep. of Germany .

*Primary Examiner*—Stuart S. Levy

*Assistant Examiner*—Steven M. du Bois

*Attorney, Agent, or Firm*—Sprung Horn Kramer & Woods

[57] ABSTRACT

A device for adjusting a chuck to axially tension core tubes and consisting of a driven spindle and of a spindle nut that can be displaced by the spindle and is attached to the chuck. The object is to improve the chuck-adjusting device to the extent that the force involved in tensioning the core tube can be precisely prescribed. The chuck is accordingly connected to the spindle nut by a frictional connection that is subjected to pressure from a force generator and can be released from that pressure by the recoil exerted at the core tube during axial tensioning.

4 Claims, 2 Drawing Sheets

DEVICE FOR ADJUSTING A CHUCK TO AXIALLY TENSION CORE TUBES

BACKGROUND OF THE INVENTION

The invention concerns a device for adjusting a chuck to axially tension core tubes and consisting of a driven spindle and of a spindle nut that can be displaced by the spindle and is attached to the chuck.

Several adjusting devices of this type are mounted on spiders that support the reels in a known unwinder. The chuck, which has a conical shell for example, moves back and forth axially along a rail in relation to the core tube. The spindle is driven by a motor and an angled transmission. The force with which the expanding-core chuck that travels axially into the core tube can be adjusted, cannot be precisely prescribed in an unwinder of this type, and, if that force is too powerful, the resulting radial force may be strong enough to tear the cores, which can no longer be used.

SUMMARY OF THE INVENTION

The object of the invention is to improve the chuck-adjusting device to the extent that the force involved in tensioning the core tube can be precisely prescribed.

The object is attained in accordance with the invention in a device of the aforesaid type of the improvement wherein the chuck is connected to the spindle nut by a frictional connection that is subjected to pressure from a force generator and can be released from that pressure by the recoil exerted at the core tube during axial tensioning.

The device in accordance with the invention allows core tubes of different length to be tensioned at prescribed tensions. The spindle and spindle nut will continue to displace the chuck axially as long as a particular tension is not exceeded. Once the recoil exerted at the core tube, that is, the pressure involved in establishing the frictional connection, exceeds a certain limit, however, the connection will be disestablished. The driven spindle will no longer axially displace the nut that rests on it, and both the nut and the spindle will begin to rotate. It accordingly becomes impossible for the pressure to increase.

The force generated by the force generator in one embodiment of the invention can be varied. The force generator can be a compression spring. The tension already existing in a force generator of this type can be varied to obtain the desired pressure.

To center the spindle nut, it can in another embodiment of the invention rotate on the chuck.

BRIEF DESCRIPTION OF THE DRAWINGS

The invention will now be specified with reference to the drawings, wherein.

DETAILED DESCRIPTION OF THE INVENTION

Figure 1:
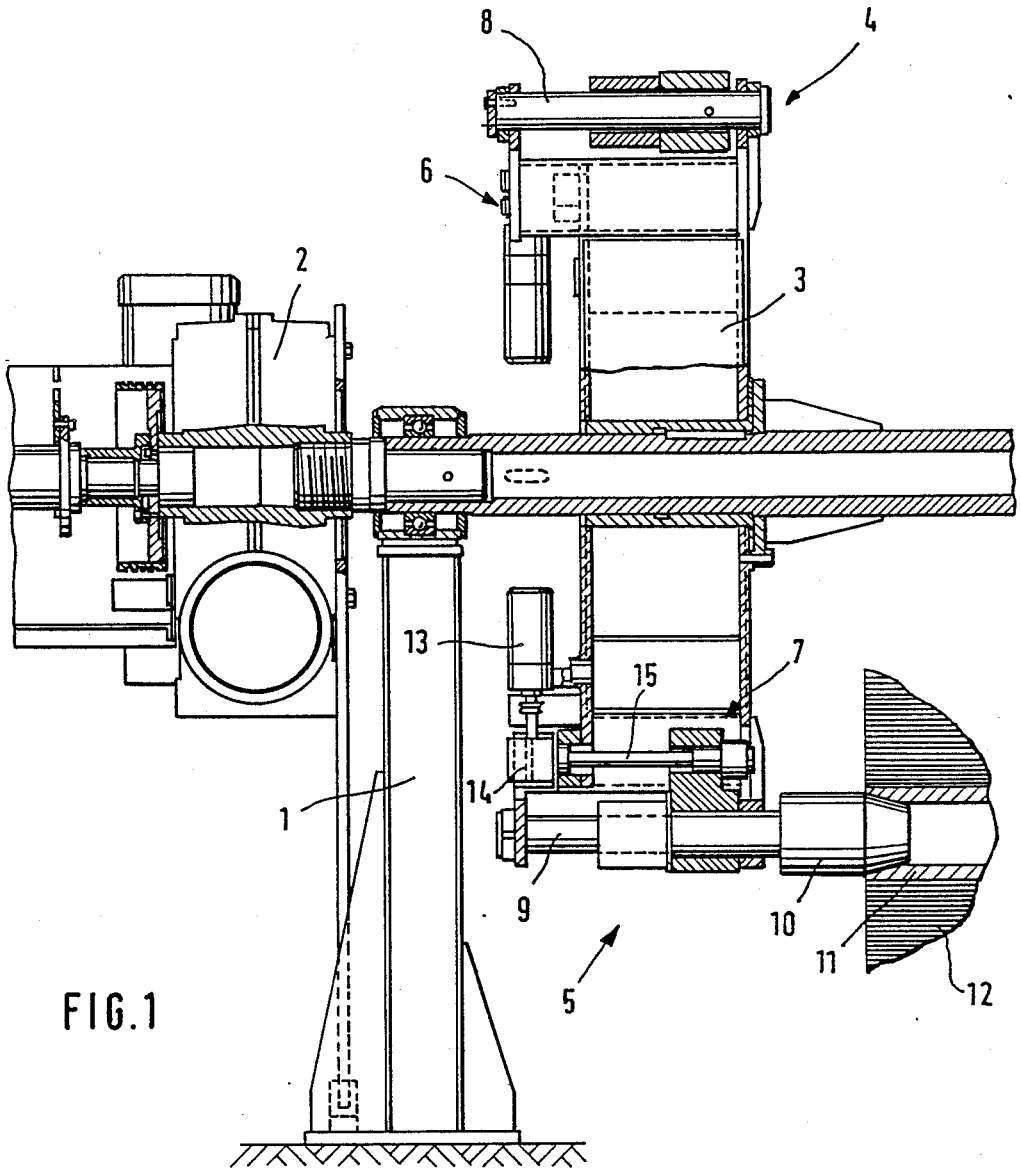
FIG. 1 is an axially section through one side of an unwinder with a spider accommodating devices for adjusting chucks.
Figure 2:
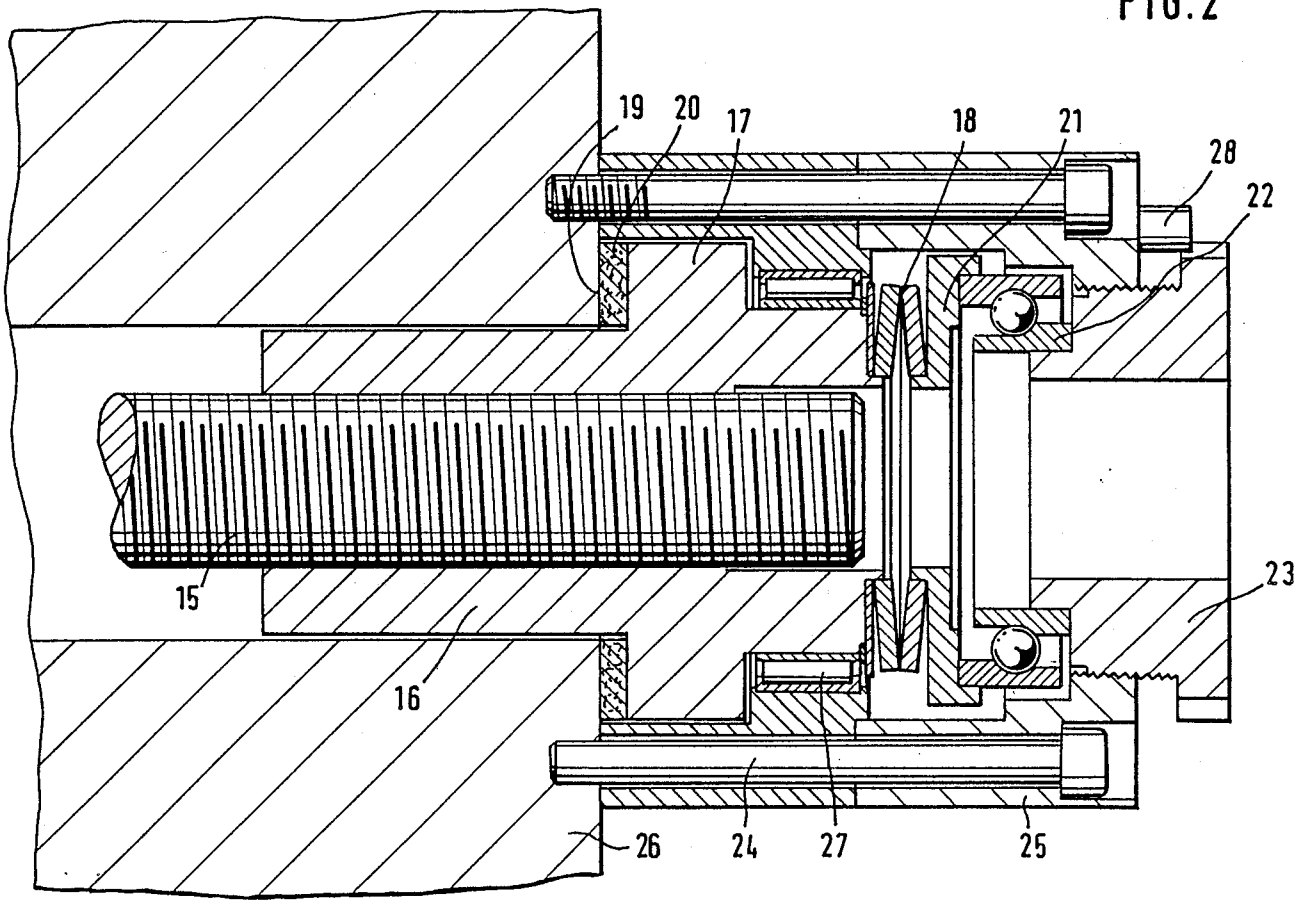
FIG. 2 is an axial section through the device illustrated in FIG. 1.

Referring to FIGS. 1 and 2, a spider 3 rotates on a drive mechanism 2 on a frame 1. At the end of spider 3, chucks 4 and 5 are mounted on rails 8 and 9, along which they can be axially displaced by a motor-driven adjusting device 6 and 7. Rotating on the front of chuck 5 is a conical shell 10 that engages a core tube 11, around which is wound a web 12 of material.

Chuck-adjusting device 6 and 7 includes a spindle 15 that is driven by a motor 13 by way of an angled transmission 14. Resting on spindle 15 is a nut 16 with an annular collar 17 (FIG. 2) that, subject to a force generator in the form of a cup spring 18, forces the nut against a shoulder 19 on a chuck component 26 through an intermediate frictional coating 20. Cup spring 18 rests against a support 21 that rests in turn, by way of a ball bearing 22 against an adjusting nut 23. Adjusting nut 23 rests in a ring 25 that is secured to chuck component 26 by threaded bolts 24. Spindle nut 16 is also accommodated in another bearing 27 in ring 25.

The tension of cup spring 18 can be adjusted by displacing adjusting nut 23 in ring 25. A particular rotational angle can be maintained by means of a pin 28 on ring 25 that engages a groove on the outside of adjusting nut 23.

How the chuck-adjusting device operates will now be specified.

The rotation of spindle 15 displaces collar 17, which is maintained against chuck component 26 by the frictional connection, axially in relation to spindle 15. Spindle nut 16 entrains chuck 5 and advances it toward core tube 11. Axial tension becomes established when shell 10 comes to rest against core tube 11 and cannot be advanced any farther. Due to the pressure exerted on cup spring 18 by adjusting nut 23, spindle nut 16 will not rotate along with chuck component 26 until the limit of pressure is exceeded. At that point, the frictional connection consisting of collar 17, shoulder 19, and frictional coating 20 will become disestablished and, as spindle 15 continues to rotate, spindle nut 16 will rotate along with cup spring 18 an support 21 in bearings 22 and 27, and no more axial displacement will occur.

The result is that a prescribed axial tension will not be exceeded.

Appropriate instruments can be employed to monitor the moment of the connection at the instant the frictional connection becomes disestablished and to disengage the mechanism that drives spindle 15 in accordance with the results.

What is claimed is:

1. In a device for adjusting a chuck to axially tension core tubes and including a driven spindle, a spindle nut displaceable by the spindle and means connecting the spindle nut to the chuck, the improvement wherein the means connecting the spindle nut to the chuck comprises frictional connection means comprising a force generator exerting pressure to effect a frictional connection and means responsive to the recoil exerted at the core tube during axial tensioning to release the pressure exerted by the force generator to disestablish the frictional connection.

2. The chuck-adjusting device as in claim 1, further comprising means for varying the force generated by the force generator.

3. The chuck-adjusting device as in claim 1 or 2, wherein the force generator is a compression ring.

4. The chuck-adjusting device as in claim 1, wherein the spindle nut rotates on the spindle.

* * * * *